US006327941B1

(12) United States Patent
Cheng

(10) Patent No.: US 6,327,941 B1
(45) Date of Patent: Dec. 11, 2001

(54) SOCKET WRENCH EXTENSION STRUCTURE

(75) Inventor: Chin-Shun Cheng, No. 209, Lan-Woo Road, Taichung (TW)

(73) Assignee: Chin-Shun Cheng, Taichung (TW)

( * ) Notice: Subject to any disclaimer, the term of this patent is extended or adjusted under 35 U.S.C. 154(b) by 0 days.

(21) Appl. No.: 09/566,473

(22) Filed: May 8, 2000

(51) Int. Cl.[7] ..... B25B 23/16

(52) U.S. Cl. ..... 81/177.2; 81/177.1; 81/489; 81/177.85

(58) Field of Search ..... 81/177.1, 177.2, 81/489, 177.85

(56) References Cited

U.S. PATENT DOCUMENTS 5,291,809 * 3/1994 Fox, III et al. .
5,531,140 * 7/1996 Chow .
5,752,418 * 5/1998 Robins .
6,006,632 * 12/1999 Hsieh .
6,062,112 * 5/2000 Bonniot .

* cited by examiner

*Primary Examiner*—Timothy V. Eley
*Assistant Examiner*—Willie Berry, Jr.

(57) ABSTRACT

A socket wrench extension structure includes an extension shank having one distal end defining a longitudinal circular chamber, a ball receiving hole defined in an outer periphery of the distal end of the extension shank and connecting to the circular chamber, a knob receiving hole defined in the outer periphery of the distal end of the extension shank and connecting to the circular chamber, a drive rod slidably mounted in the circular chamber and having a first end defining a ball receiving recess aligning with the ball receiving hole of the extension shank and a second end defining a knob receiving recess aligning with the knob receiving hole of the extension shank, a biasing member mounted in the circular chamber of the extension shank and biased between the second end of the drive rod and a wall of the circular chamber, a ball movably mounted in the ball receiving hole and slidably received in the ball receiving recess, and a press knob movably mounted in the knob receiving hole and slidably received in the knob receiving recess.

1 Claim, 8 Drawing Sheets

SOCKET WRENCH EXTENSION STRUCTURE

BACKGROUND OF THE INVENTION

1. Field of the Invention

The present invention relates to an extension structure for a tool, and more particularly to a socket wrench extension structure.

2. Description of the Related Art

A first conventional socket wrench extension 10 in accordance with the prior art shown in FIG. 1 includes a first end formed with a connector 12 which can be coupled with a socket (not shown), and a second end formed with an enlarged head 14 which defines a square recess (not shown) therein for receiving a square head (not shown) of a socket wrench (not shown). The connector 12 includes a ball (not shown) provided thereon so that the socket can be tightly mounted on the connector 12 of the socket wrench extension 10. However, the user has to exert a large force for detaching the socket from the connector 12 of the socket wrench extension 10 so that the socket cannot be quickly mounted on or detached from the connector 12 of the socket extension shank 10, thereby causing inconvenience in operation of the socket extension shank 10.

A second conventional socket wrench extension 20 in accordance with the prior art shown in FIG. 2 includes a first end formed with a connector 22 for coupling with a socket (not shown), and a second end formed with an enlarged head 24 defining a hexagonal recess 21 therein for driving a screw (not shown). However, the user also has to exert a large force for detaching the socket from the connector 22 of the socket wrench extension 20 so that the socket cannot be quickly mounted on or detached from the connector 22 of the socket extension shank 20, thereby causing inconvenience in operation of the socket extension shank 20.

The closest prior arts of which the applicant is aware are disclosed in the following patents:

1. U.S. Pat. No. 5,289,745;
2. U.S. Pat. No. 5,720,207;
3. U.S. Pat. No. 6,006,632; and
4. U.S. Pat. No. 6,003,414.

In the above-mentioned four patens, an elongated channel is formed in the socket wrench extension so that the ball can be received into the connector of the socket wrench extension, thereby facilitating the socket being detached from the connector of the socket wrench extension. However, it is difficult to drill such an elongated channel in the socket wrench extension. In practice, a long drilling head with a smaller diameter is used for drilling the elongated channel in the socket wrench extension so that the drilling head is easily broken during the drilling process, thereby increasing the difficulty of working, increasing the time required for drilling the elongated channel, and increasing the cost of fabrication.

Another closest prior art of which the applicant is aware is disclosed in U.S. Pat. No. 5,813,296. In the above-mentioned patent, the ball can also be received into the connector of the socket wrench extension, thereby facilitating the socket being detached from the connector of the socket wrench extension. However, the socket wrench extension includes a complicated construction consisting of many parts, thereby greatly increasing the cost of fabrication.

SUMMARY OF THE INVENTION

The present invention has arisen to mitigate and/or obviate the disadvantage of the conventional socket wrench extension.

In accordance with one aspect of the present invention, there is provided a socket wrench extension structure comprising an elongated extension shank having one distal end defining a longitudinal circular chamber, a ball receiving hole defined in an outer periphery of the one distal end of the extension shank and connecting to the circular chamber, a knob receiving hole defined in the outer periphery of the one distal end of the extension shank and connecting to the circular chamber; a drive rod slidably mounted in the circular chamber and having a first end defining a ball receiving recess aligning with the ball receiving hole of the extension shank and a second end defining a knob receiving recess aligning with the knob receiving hole of the extension shank; a biasing member mounted in the circular chamber of the extension shank and biased between the second end of the drive rod and a wall of the circular chamber; a ball movably mounted in the ball receiving hole and slidably received in the ball receiving recess; and a press knob movably mounted in the knob receiving hole and slidably received in the knob receiving recess.

Preferably, the knob receiving recess includes an arcuate guide surface for guiding the press knob into the knob receiving recess.

Preferably, the second end of the drive rod includes a retaining stub extending outward and secured to the biasing member for retaining and limiting the biasing member.

Further benefits and advantages of the present invention will become apparent after a careful reading of the detailed description with appropriate reference to the accompanying drawings.

DETAILED DESCRIPTION OF THE INVENTION

Figure 1:
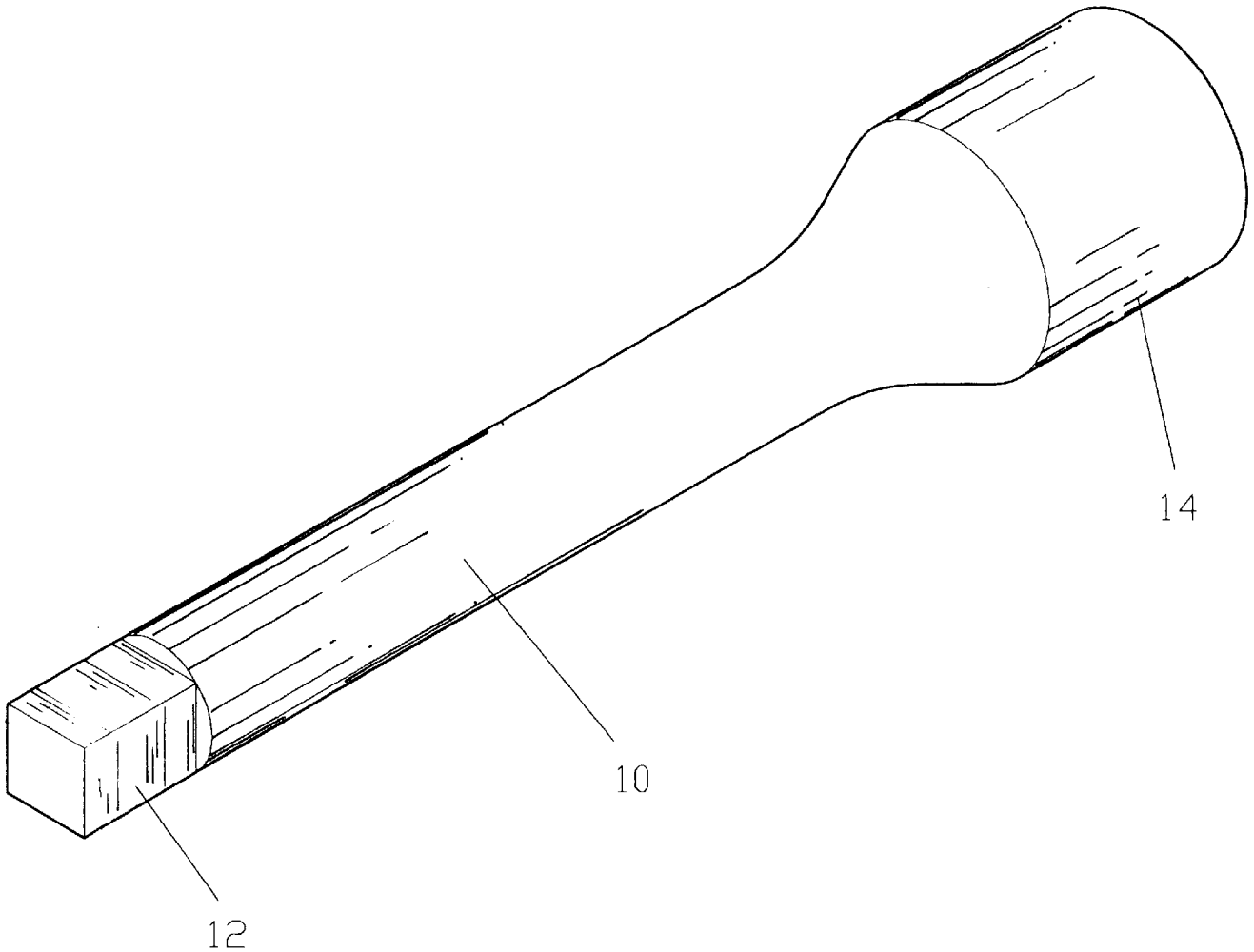
FIG. 1 PRIOR ART
FIG. 1 is a perspective view of a first conventional socket wrench extension in accordance with the prior art.
Figure 2:
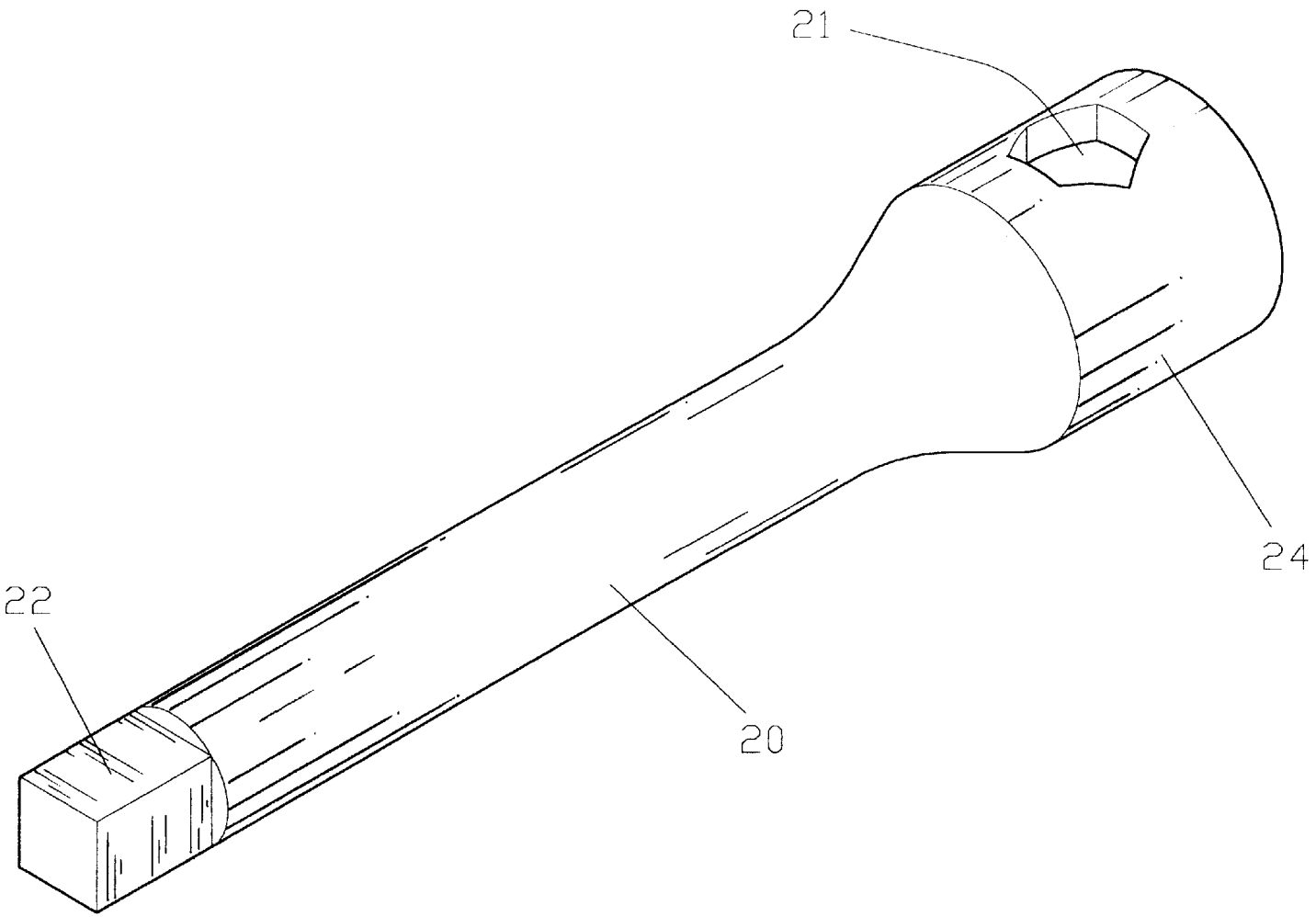
FIG. 2 PRIOR ART
FIG. 2 is a perspective view of a second conventional socket wrench extension in accordance with the prior art.
Figure 3:
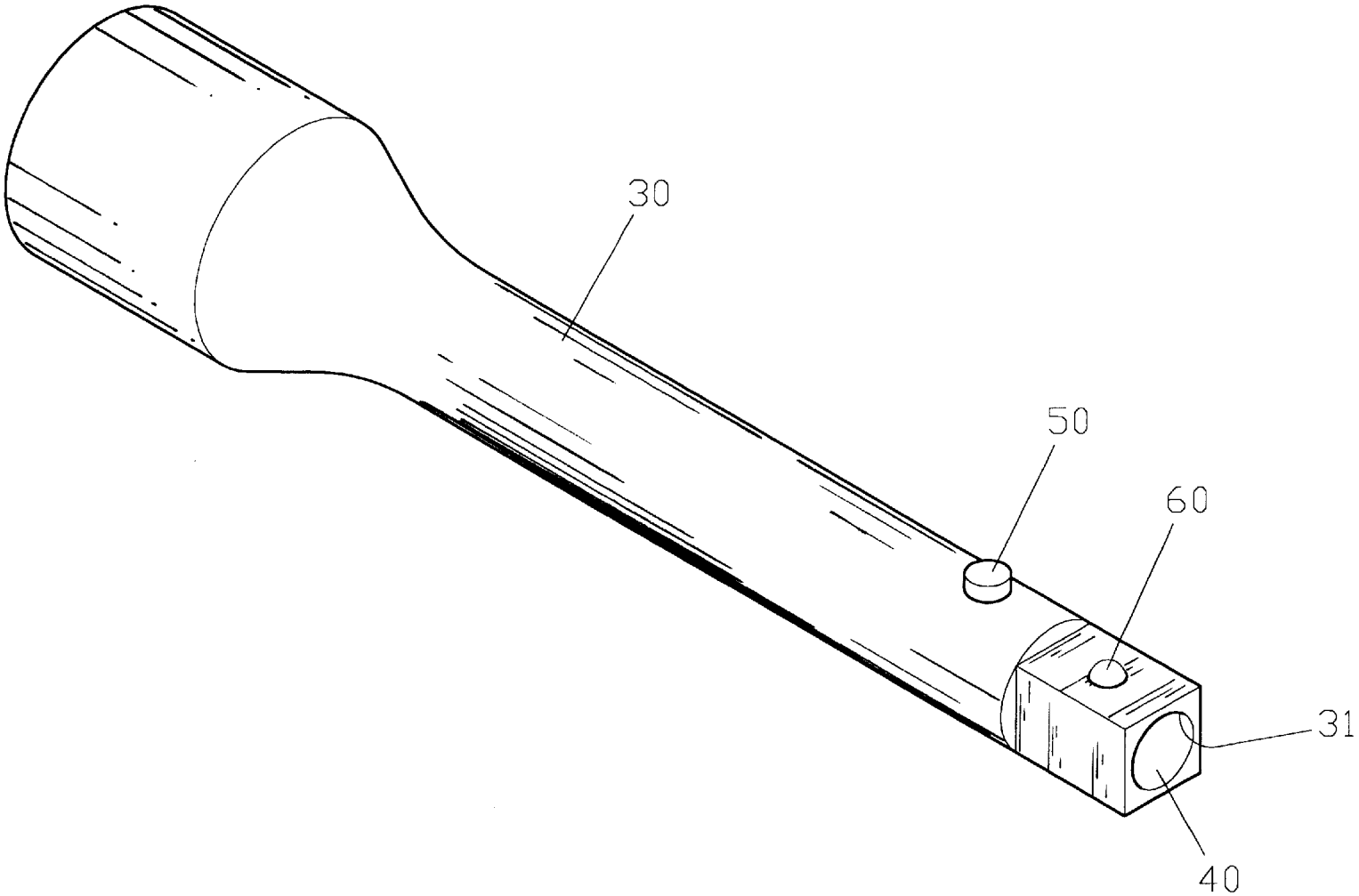
FIG. 3 is a perspective view of a socket wrench extension structure in accordance with the present invention.
Figure 4:
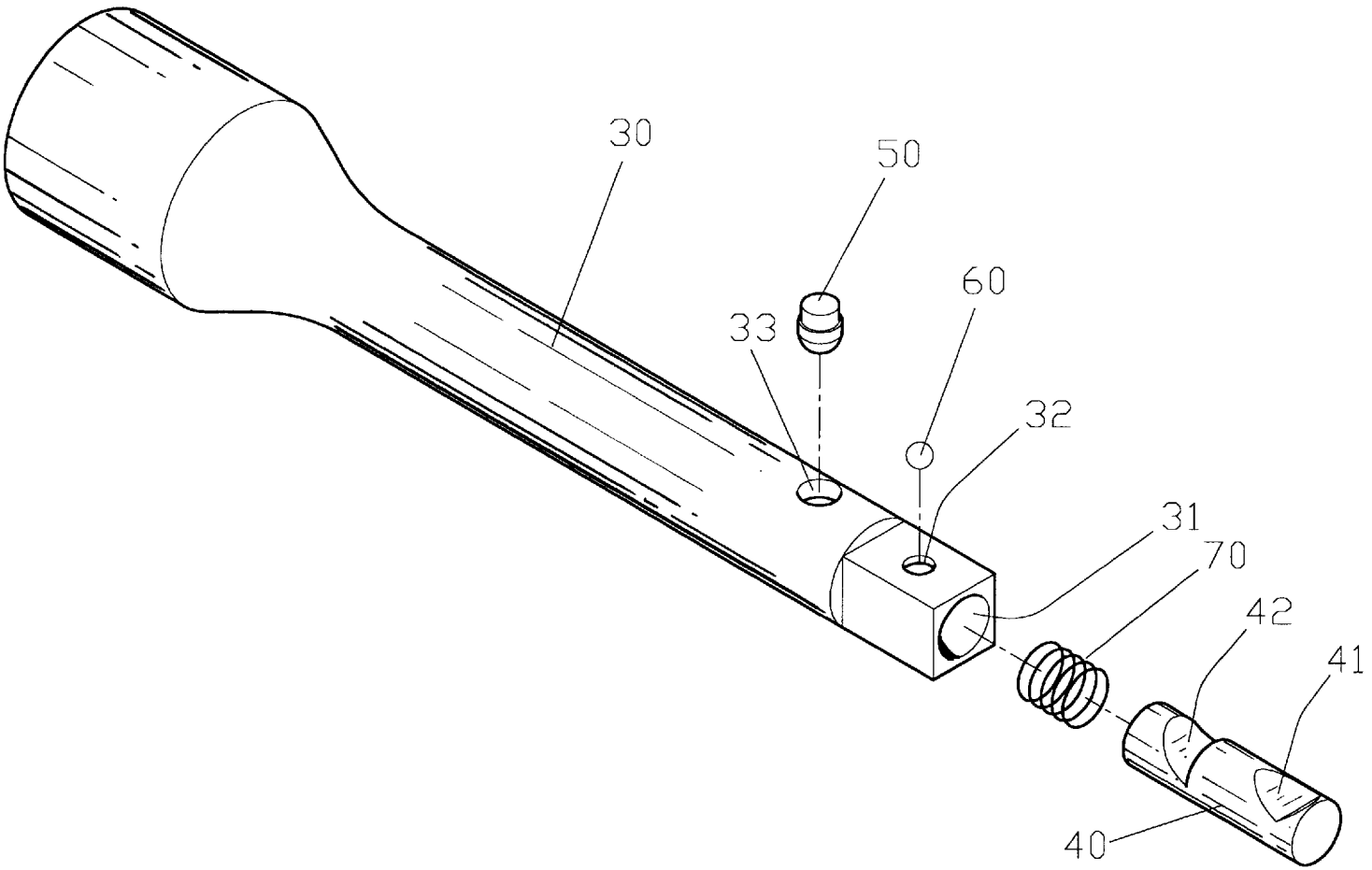
FIG. 4 is an exploded view of the socket wrench extension structure as shown in FIG. 3.
Figure 5:
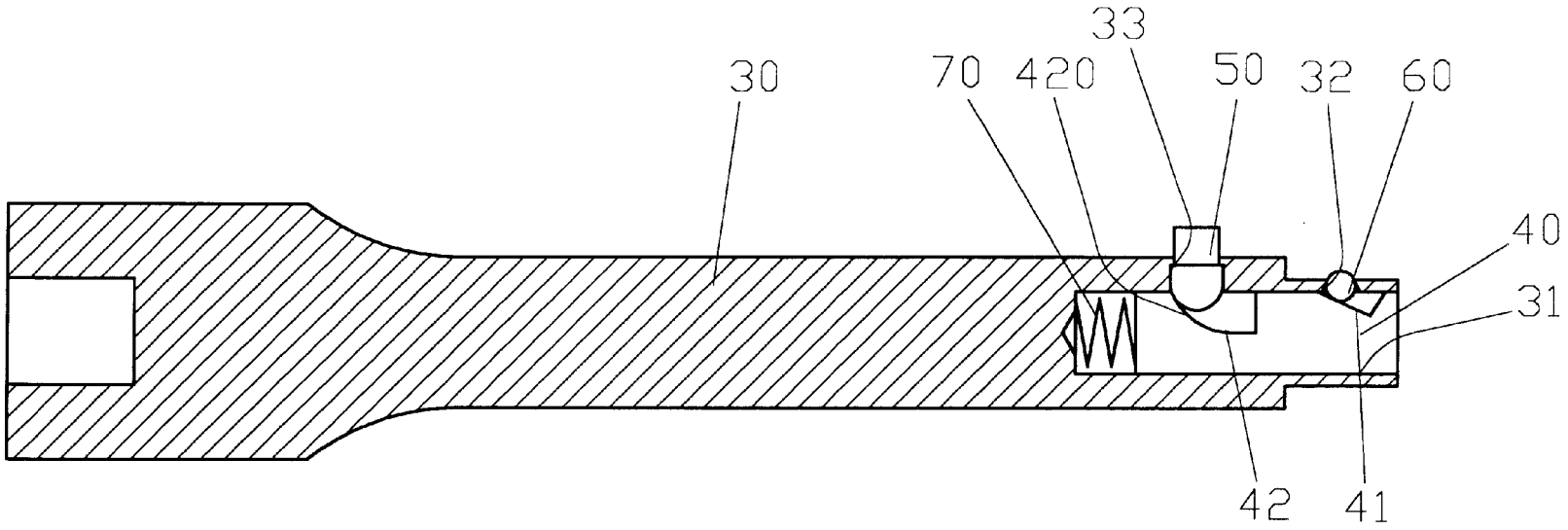
FIG. 5 is a front plan cross-sectional view of the socket wrench extension structure as shown in FIG. 3.

Referring to the drawings and initially to FIGS. 3–5, a socket wrench extension structure in accordance with the present invention comprises an elongated extension shank 30 having its one distal end (or connector end) defining a longitudinal circular chamber 31, a ball receiving hole 32 defined in an outer periphery of the one distal end of the extension shank 30 and connecting to the circular chamber 31, a knob receiving hole 33 defined in the outer periphery of the one distal end of the extension shank 30 and connecting to the circular chamber 31, a drive rod 40 slidably mounted in the circular chamber 31 and having a first end defining a ball receiving recess 41 aligning with the ball receiving hole 32 of the extension shank 30 and a second end defining a knob receiving recess 42 aligning with the knob receiving hole 33 of the extension shank 30, a biasing member 70, such as a spring, mounted in the circular chamber 31 of the extension shank 30 and biased between the second end of the drive rod 40 and a wall of the circular chamber 31, a ball 60 movably mounted in the ball receiving hole 32 and slidably received in the ball receiving recess 41, and a press knob 50 movably mounted in the knob receiving hole 33 and slidably received in the knob receiving recess 42.

The drive rod 40 has a length slightly smaller than that of the circular chamber 31 so that a space is defined between the wall of the circular chamber 31 and the second end of the drive rod 40 for receiving the biasing member 70.

The ball receiving recess 41 has a depth different from that of the knob receiving recess 42. The knob receiving recess 42 includes an arcuate guide surface 420 for smoothly guiding and introducing the press knob 50 into the knob receiving recess 42. The press knob 50 is partially exposed outward from the knob receiving hole 33 of the extension shank 30.

In assembly, the biasing member 70 is initially received into the circular chamber 31 of the extension shank 30, and the drive rod 40 is then inserted into the circular chamber 31 of the extension shank 30. The ball 60 is then received into the ball receiving hole 32 of the extension shank 30, and is partially received in the ball receiving recess 41 of the drive rod 40. Then, the ball receiving hole 32 of the extension shank 30 is processed by a punching method so that the outlet opening of the ball receiving hole 32 of the extension shank 30 is punched to have a diameter smaller than that of the ball 60, thereby preventing the ball 60 from detaching from the ball receiving hole 32 of the extension shank 30.

In such a manner, the first end of the drive rod 40 is also retained by the ball 60 which is partially received in the ball receiving recess 41 of the drive rod 40, thereby preventing the drive rod 40 from detaching from the circular chamber 31 of the extension shank 30.

The press knob 50 is then received into the knob receiving hole 33 of the extension shank 30, and is partially received in the knob receiving recess 42 of the drive rod 40. Then, the knob receiving hole 33 of the extension shank 30 is processed by a punching method so that the outlet opening of the knob receiving hole 33 of the extension shank 30 is punched to have a diameter smaller than that of the press knob 50, thereby preventing the press knob 50 from detaching from the knob receiving hole 33 of the extension shank 30.

Figure 6:
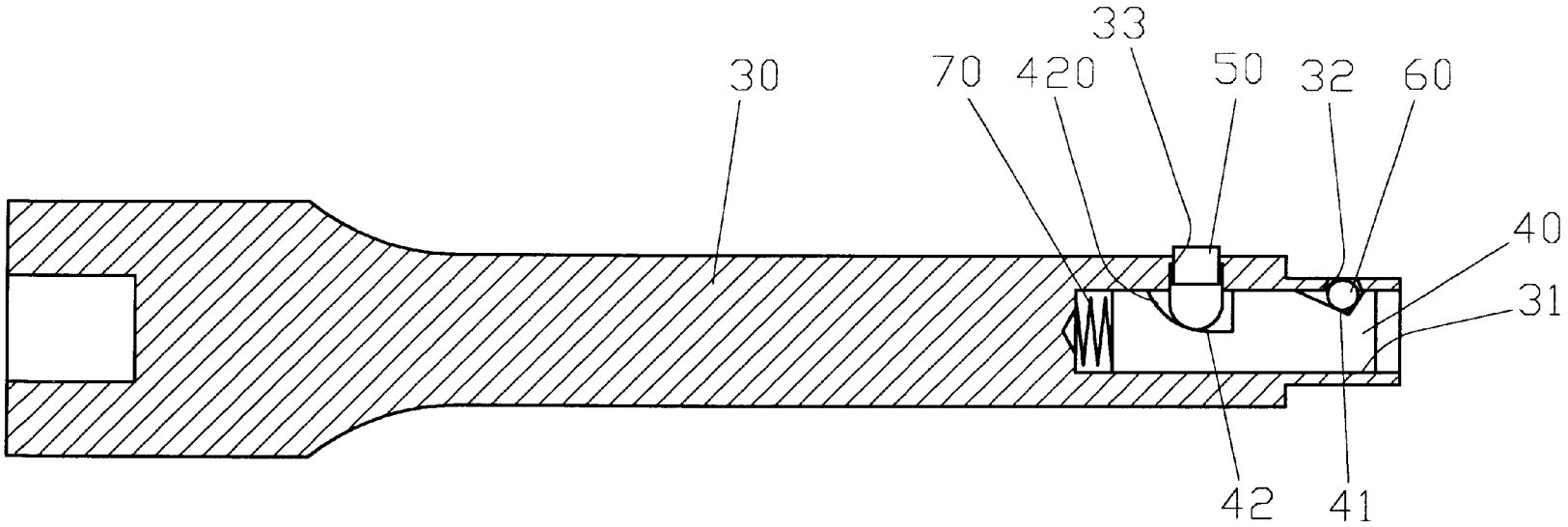
FIG. 6 is an operational view of the socket wrench extension structure as shown in FIG. 5.
Figure 7:
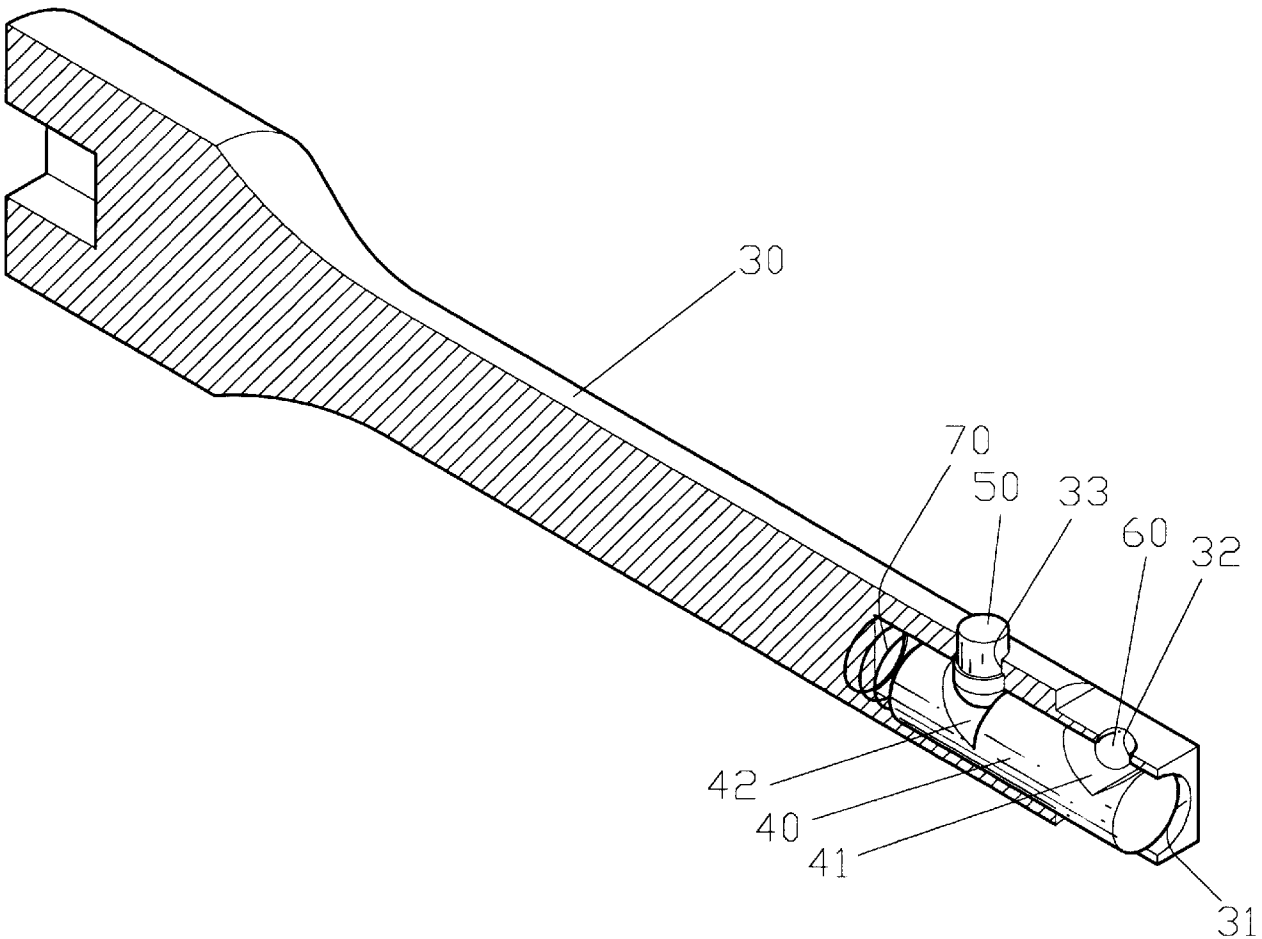
FIG. 7 is a partially cut-away perspective view of the socket wrench extension structure as shown in FIG. 6.

In operation, referring to FIGS. 5–7 with reference to FIGS. 3 and 4, the press knob 50 is partially exposed outward from the knob receiving hole 33 of the extension shank 20, and the ball 60 is partially exposed outward from the ball receiving hole 32 of the extension shank 20 as shown in FIG. 5.

The press knob 50 is then pressed inward to be fully received in the knob receiving hole 33 of the extension shank 20, and is further pressed into the knob receiving recess 42 of the drive rod 40 through the arcuate guide surface 420 of the knob receiving recess 42 of the drive rod 40 to move the drive rod 40 inward in the circular chamber 31 from the position as shown in FIG. 5 to the position as shown in FIG. 6 to press the biasing member 670, whereby the ball receiving recess 41 of the drive rod 40 is moved to actually align with the ball 60 so that the ball 60 can be fully received in the deeper portion of the ball receiving recess 41 of the drive rod 40 as shown in FIGS. 6 and 7.

In such a manner, the ball 60 is fully received in the ball receiving recess 41 of the drive rod 40 by pressing the press knob 50 so that the extension shank 30 can be easily and quickly inserted into and detached from a socket (not shown) without having to exert a large force for separating the socket from the extension shank 30, thereby facilitating a user operating the extension shank 30, and thereby increasing the versatility of the extension shank 30.

The drive rod 40 can then be returned to its original position by the restoring force of the biasing member 70 when the pressing force exerted on the press knob 50 is removed so that the press knob 50 is partially exposed outward from the knob receiving hole 33 of the extension shank 20, and the ball 60 is partially exposed outward from the ball receiving hole 32 of the extension shank 20 as shown in FIG. 5.

Figure 8:
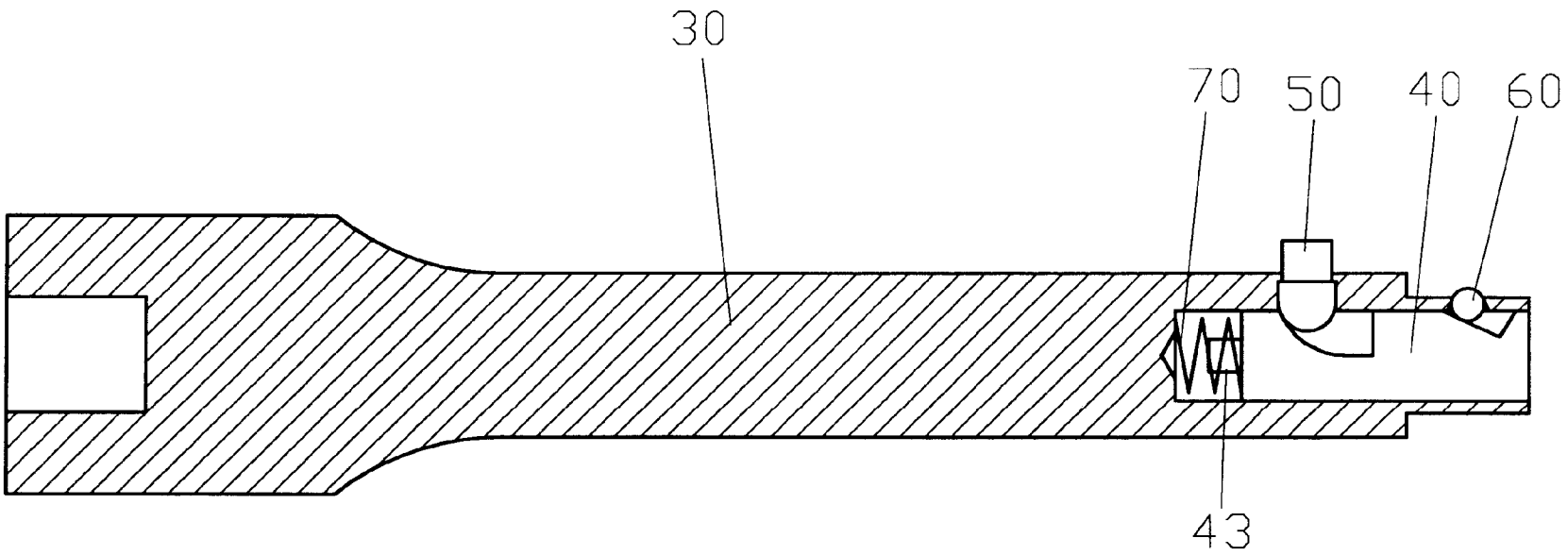
FIG. 8 is a front plan cross-sectional view of the socket wrench extension structure in accordance with another embodiment of the present invention.

Referring to FIG. 8, the second end of the drive rod 40 includes a retaining stub 43 extending outward and secured to the biasing member 70 for retaining and limiting the biasing member 70.

Accordingly, the socket wrench extension structure in accordance with the present invention can provide the following advantages.

First, the socket wrench extension structure comprises fewer parts, thereby decreasing the cost of fabrication.

Second, by means of pressing the press knob, the extension shank of the socket wrench extension structure can be easily and quickly inserted into and detached from a socket without having to exert a large force for separating the socket from the extension shank, thereby facilitating a user operating the extension shank of the socket wrench extension structure, and increasing the versatility of the extension shank of the socket wrench extension structure.

It should be clear to those skilled in the art that further embodiments may be made without departing from the scope of the present invention.

What is claimed is:

1. A socket wrench extension structure comprising:

an elongated extension shank (30) having one distal end defining a longitudinal circular chamber (31), a ball receiving hole (32) defined in an outer periphery of said one distal end of said extension shank (30) and connecting to said circular chamber (31), a knob receiving hole (33) defined in said outer periphery of said one distal end of said extension shank (30) and connecting to said circular chamber (31);

a drive rod (40) slidably mounted in said circular chamber (31) and having a first end defining an arcuate ball receiving recess (41) aligning with said ball receiving hole (32) of said extension shank (30) and a second end defining an arcuate knob receiving recess (42) aligning with said knob receiving hole (33) of said extension shank (30), said drive rod (40) having a length slightly smaller than that of said circular chamber (31), said ball receiving recess (41) having a depth different from that of said knob receiving recess (42);

a biasing member (70) mounted in said circular chamber (31) of said extension shank (30) and biased between said second end of said drive rod (40) and a wall of said circular chamber (31);

a ball (60) movably mounted in said ball receiving hole (32) and slidably received in said ball receiving recess (41); and a press knob (50) movably mounted in said knob receiving hole (33) and slidably received in said knob receiving recess (42);

wherein, said knob receiving recess (42) includes an arcuate guide surface (420) for guiding said press knob (50) into said knob receiving recess (42), said press knob (50) is partially exposed outward from said knob receiving hole (33) of said extension shank (30), said second end of said drive rod (40) includes a retaining stub (43) extending outward and secured to said biasing member (70) for retaining and limiting said biasing member (70).

* * * * *